US006202720B1

(12) United States Patent
Loth et al.

(10) Patent No.: US 6,202,720 B1
(45) Date of Patent: Mar. 20, 2001

(54) KNIFE-RING CHIP REMOVER

(75) Inventors: Robert Loth, Lage-Mussen; Rolf Ameling, Bielefeld, both of (DE)

(73) Assignee: B. Maier Zerkleinerungstechnik GmbH, Bielefeld (DE)

( * ) Notice: Subject to any disclaimer, the term of this patent is extended or adjusted under 35 U.S.C. 154(b) by 0 days.

(21) Appl. No.: 09/293,727

(22) Filed: Apr. 16, 1999

(30) Foreign Application Priority Data

Apr. 29, 1998 (DE) ..... 198 19 125

(51) Int. Cl.[7] ..... B27L 11/02
(52) U.S. Cl. ..... 144/172; 144/162; 83/698.41
(58) Field of Search ..... 144/162.1, 172, 144/173, 174; 241/291, 299; 83/403, 698.41, 906

(56) References Cited

U.S. PATENT DOCUMENTS 3,371,693 * 3/1968 Voelskow ..... 144/172
4,391,172 * 7/1983 Galland et al. ..... 83/403
4,493,352 * 1/1985 Jaakonmäki et al. ..... 144/162.1

FOREIGN PATENT DOCUMENTS 93 07 371 U1 2/1994 (DE) .

* cited by examiner

*Primary Examiner*—Rinaldi I. Rada
*Assistant Examiner*—Melissa Hall
(74) *Attorney, Agent, or Firm*—Ohlandt, Greeley, Ruggiero & Perle, L.L.P.

(57) ABSTRACT

There is provided a knife-ring remover for chips having a knife ring arranged rigidly on an axis. The knife ring has a collar of knives and first and second bearing rings concentric to the axis. A housing, that partly encloses the knife ring, has a rear wall, an essentially cylindrical sheath and a door disposed opposite to the rear wall for driving out a rotor. The rotor has a pair of front walls that bear a plurality of blades. The rotor is mounted in a rotatable manner on the axis. First and second abrasion sealing rings are disposed in the regions of the first and second bearing rings. Each abrasion sealing ring has an inner axial edge that lies at least approximately in the same plane perpendicular to the axis as an axial inner edge of the corresponding bearing ring. One abrasion sealing ring is connected to the door and the other is attached directly or indirectly to the rear wall.

3 Claims, 2 Drawing Sheets

KNIFE-RING CHIP REMOVER

FIELD OF INVENTION

The invention concerns a knife-ring chip remover.

BACKGROUND OF INVENTION

Knife-ring chip removers are known, in which a knife ring is arranged in a stationary manner on an axis in a housing. Further, a rotor, for example, in the form of a spinner blade can be mounted in a rotating manner on this horizontal axis. The knife ring comprises a circular ring-shape bearing structure, on the periphery of which is arranged a multiple number of knife-bearing elements such that these elements together form a space for discharging chips.

In chip removers of this type, there are always additional problems in the region between the rotating rotor and the stationary knife ring. In the region of the two bearing rings of the knife ring there exists a gap. Chips can migrate through this gap upon rotation of the rotor and arrive in the discharge space. The size of the chips is variable. It thus may happen that chips of a large size enter into the discharge space. This is undesired, since then the chip quality is no longer uniform.

DE 93 07 371 U1 shows and describes a knife-ring chip remover, in which an abrasion-sealing ring is provided in the region of each front wall of the rotor as well as in the [region] belonging to the two bearing rings of the knife ring. However, the named abrasion sealing ring is attached each time on the front side of the rotor. In the region of the two bearing rings of the knife ring, there thus exists a gap. Chips can pass through this gap during rotation of the rotor, which is undesired.

SUMMARY OF INVENTION

The invention takes on the task of creating a knife-ring chip remover in such a way that chips can no longer pass.

This task is resolved by the features of the claim.

The following is obtained by the abrasion sealing rings according to the invention: Based on the dimensions of the abrasion sealing rings, a fixed gap is created over the entire axial width of each bearing ring of the knife ring. The abrasion sealing rings can be dimensioned in such a way that they are directly adjacent to the inner edge of the bearing rings of the knife ring. The problem is thus resolved in an extremely simple manner.

BRIEF DESCRIPTION OF THE DRAWINGS

The invention is explained in more detail on the basis of the drawing in which.

DESCRIPTION OF PREFERRED EMBODIMENT

Figure 1:
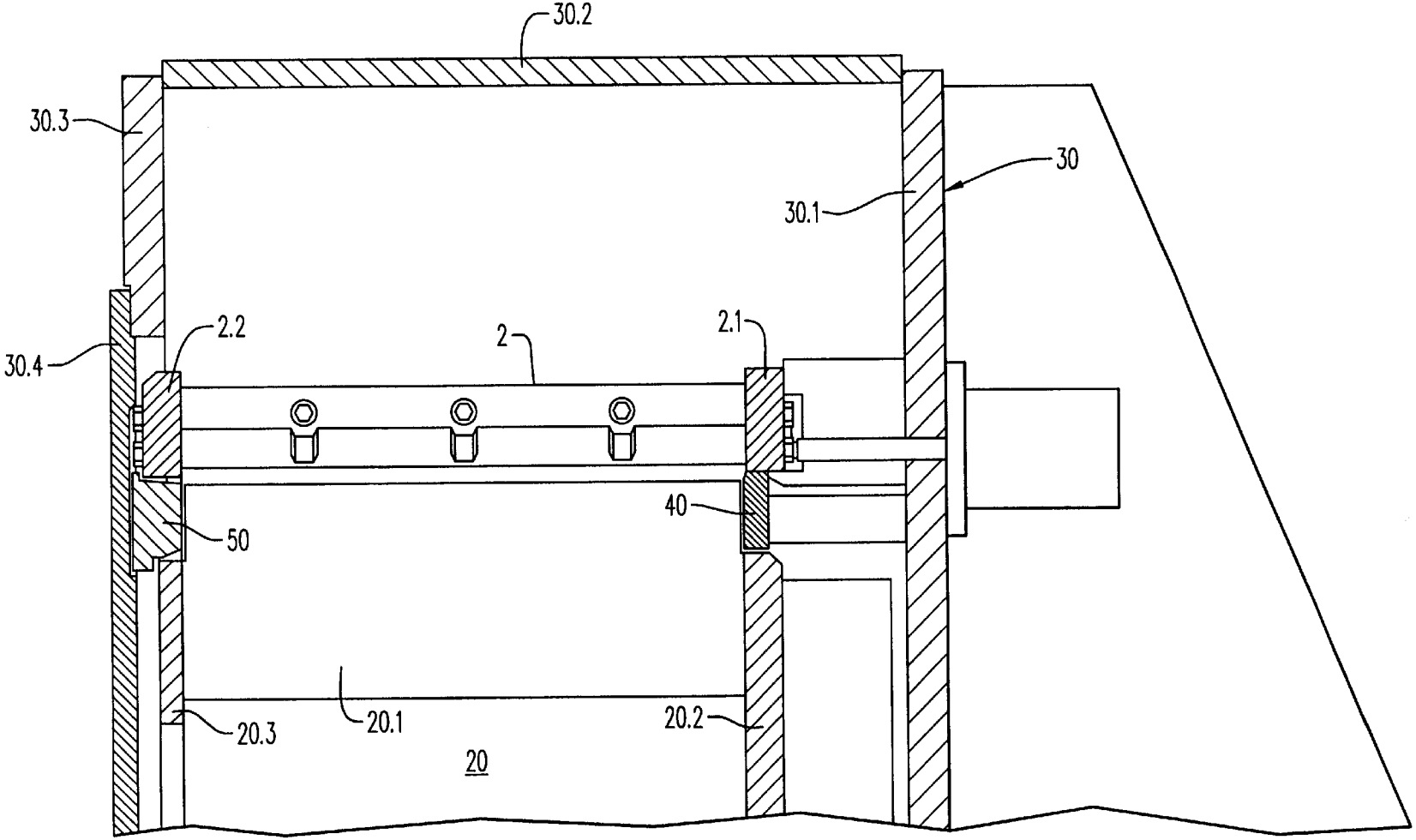
FIG. 1 is a sectional view of a knife-ring chip remover according to the present invention.

The knife-ring chip remover comprises knife ring 2, which is arranged on an axis that is not shown here individually, in a stationary manner in a housing 30.

Housing 30 comprises a rear wall 30.1, a sheath 30.2, a front wall 30.3 and a door 30.4 inserted into front wall 30.3.

The rotor 20 has a multiple number of blades 20.1. These are arranged distributed uniformly around the rotor axis. Blades 20.1 are held in a front wall 20.2, which is found in the region of rear wall 30.1 of housing 30, and in a front wall 20.3 on the front side, which is found in the region of door 30.4.

Knife ring 2 has two bearing rings 2.1 and 2.2. One bearing ring 2.1 is found in the vicinity of rear wall 30.1 of housing 30, and the other bearing ring 2.2 is found in the vicinity of door 30.4. Stated more precisely, the bearing ring 2.1 of knife ring 2 on the side of the back wall lies at least approximately in the same axial plane as front wall 20.2 of rotor 20 on the side of the rear wall. In the same way, bearing ring 2.2 of knife ring 2 lies at least approximately on the same axial plane as front wall 20.3 of rotor 20 on the door side.

The decisive elements are abrasion sealing rings 40 and 50. Abrasion sealing ring 40 is attached onto rear wall 30.1 of housing 30 with the intermediate joining of other structural components. Sealing ring 50 is attached in an adjustable manner to door 30.4. The two abrasion sealing rings 40 and 50 connect tightly to the two bearing rings 2.1 and 2.2. Therefore, no chips can pass through between abrasion sealing rings 40 and 50 and bearing rings 2.1 and 2.2.

As can be seen further, in the present example of embodiment, the axial inner surfaces of bearing rings 2.1 and 2.2 of the knife ring 2, the abrasion sealing rings 40 and 50 as well as front walls 20.1 and 20.2 of rotor 20 lie in one and the same plane, which is perpendicular to the axis. Both abrasion sealing rings 40 and 50 thus cover, at least extensively and viewed in the axial direction, the two bearing rings 2.1 and 2.2.

The attachment of the front abrasion sealing ring 50 to door 30.4 has yet another advantage: door 30.4 can be opened without having to demount the abrasion sealing ring 50. This is particularly the case if abrasion sealing ring 50 is rotated like a ball. This has great advantages relative to demounting and remounting the knife as well as in the cleaning of knife ring 2. It has the further advantage that knife ring 2 can be utilized without problems in an automatic grinding machine, without having to demount abrasion sealing rings 40 and 50. This leads to a very considerable time savings.

Figure 2:
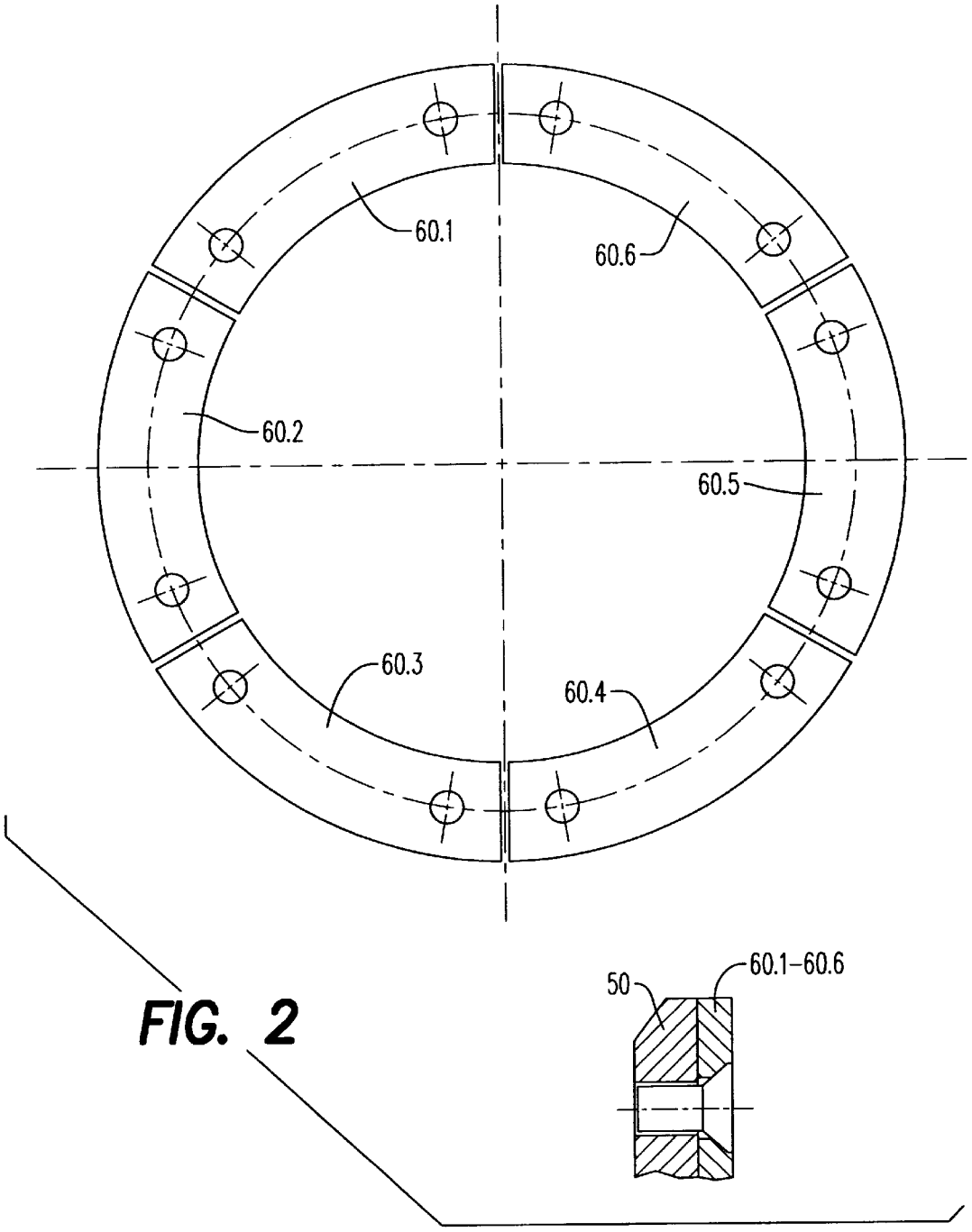
FIG. 2 is an elevational view of the sealing ring of FIG. 2.

As can be seen from FIG. 2, abrasion sealing ring (50) is covered with segments 60.1, 60.2, 60.3, 60.4, 60.5 and 60.6. In the present case, these are screwed onto the base unit of the abrasion sealing ring 50.

Not only can abrasion sealing ring 50 be constructed in such a way as shown in FIG. 2, but also abrasion sealing ring 40.

What is claimed is:

1. A knife-ring remover for chips that has a longitudinal axis, said knife ring remover comprising:

a knife ring arranged in a stationary manner on a knife ring axis, said knife ring having a collar of knives and first and second bearing rings concentric to said longitudinal axis;

a rotor having first and second spaced apart front walls and a plurality of blades disposed between said first and second front walls, said rotor being mounted in a rotatable manner on a rotor axis;

a housing partly enclosing said knife ring, said housing having a rear wall, an essentially cylindrical sheath and a door disposed opposite said rear wall for driving out said rotor;

a first abrasion sealing ring disposed in the region of said first bearing and said first front wall, said first abrasion sealing ring having an axial inner edge that lies in the same plane perpendicular to said knife ring axis as an axial inner edge of said first bearing ring, said first abrasion sealing ring being connected to said door; and a second abrasion sealing ring disposed in the region of said second bearing and said second front wall, said second abrasion sealing ring having an axial inner edge that lies in the same plane perpendicular to said knife ring axis as an axial inner edge of said second bearing ring, said second abrasion sealing ring being connected to said rear wall.

2. The knife-ring remover of claim 1, wherein said first abrasion sealing ring is attached to said door, and wherein said door can be opened without having to demount said first abrasion sealing ring.

3. The knife-ring remover of claim 1, wherein said first and second abrasion sealing rings are disposed so that there is no gap between said first and second bearings and said first and second abrasion sealing rings through which said chips may pass.

* * * * *